United States Patent [19]

Picton

[11] Patent Number: 4,832,330

[45] Date of Patent: May 23, 1989

[54] COPY FINISHING APPARATUS

[75] Inventor: Stewart D. Picton, Shefford, England

[73] Assignee: Xerox Corporation, Stamford, Conn.

[21] Appl. No.: 534,033

[22] Filed: Sep. 20, 1983

[30] Foreign Application Priority Data

Sep. 21, 1982 [GB] United Kingdom ..... 8226818

[51] Int. Cl.[4] ..... B65H 9/00

[52] U.S. Cl. ..... 271/236; 271/245; 271/248

[58] Field of Search ..... 271/236, 245, 303, 246, 271/251, 248, DIG. 9; 414/43

[56] References Cited

U.S. PATENT DOCUMENTS

| | | | |
|---|---|---|---|
| 3,948,505 | 4/1976 | Miller et al. | 271/DIG. 9 X |
| 4,073,391 | 2/1978 | O'Brien et al. | 271/246 X |
| 4,264,187 | 4/1981 | Rhodes, Jr. | 271/245 X |
| 4,275,877 | 6/1981 | Silverberg | 271/166 |
| 4,379,549 | 4/1983 | Mizuma | 271/251 X |
| 4,453,870 | 6/1984 | Bean | 414/43 |

*Primary Examiner*—Joseph J. Rolla

*Attorney, Agent, or Firm*—William A. Henry, II

[57] ABSTRACT

Copy finishing apparatus includes a compiling surface (62) for compiling sheets into sets, a registration device (71) for driving sheets into a registration corner defined by end (69) and side registration stops and a conveyor system (63, 67, 68) for conveying sheets on to surface (62) in a first direction, the surface (62) sloping downwardly towards end registration stop (69) in the opposite direction. Sheets are delivered to the surface (62) beyond the registration device (71) and the slope of surface (62) is such that they slide under gravity beneath the device (71). The apparatus suitably also includes set ejecting mechanism (73, 74) and stapler (72) and the path (63) extends over these also.

6 Claims, 9 Drawing Sheets

COPY FINISHING APPARATUS

This invention relates to copy finishing apparatus for collecting sheets into sets in which sheets conveyed onto a compiling surface in one direction are registered in the opposite direction.

According to the invention the apparatus comprises a support surface for compiling sheets fed serially thereto into sets, means arranged over said support surface for corner registering the sheets against end and side registration stops, means for conveying sheets onto the support surface in a first direction over said registration means, said support surface sloping downwardly in the opposite direction toward said end registration stop whereby sheets delivered onto said surface beyond said registration means in said one direction will move under gravity beneath said registration means.

In a preferred form, the apparatus further includes binding means and/or set ejecting means arranged over said support surface, the means for conveying sheets to the support surface extending thereover.

Preferably, the apparatus includes a second support surface for receiving and stacking sets from the compiling surface, which support surface is suitably arranged underneath said first support surface, transport means being provided for conveying sets around a direction reversing path between the upper and lower support surfaces. Single sheets may be conveyed directly to the second support surface from the input to the apparatus along a separate path.

Figure 1:
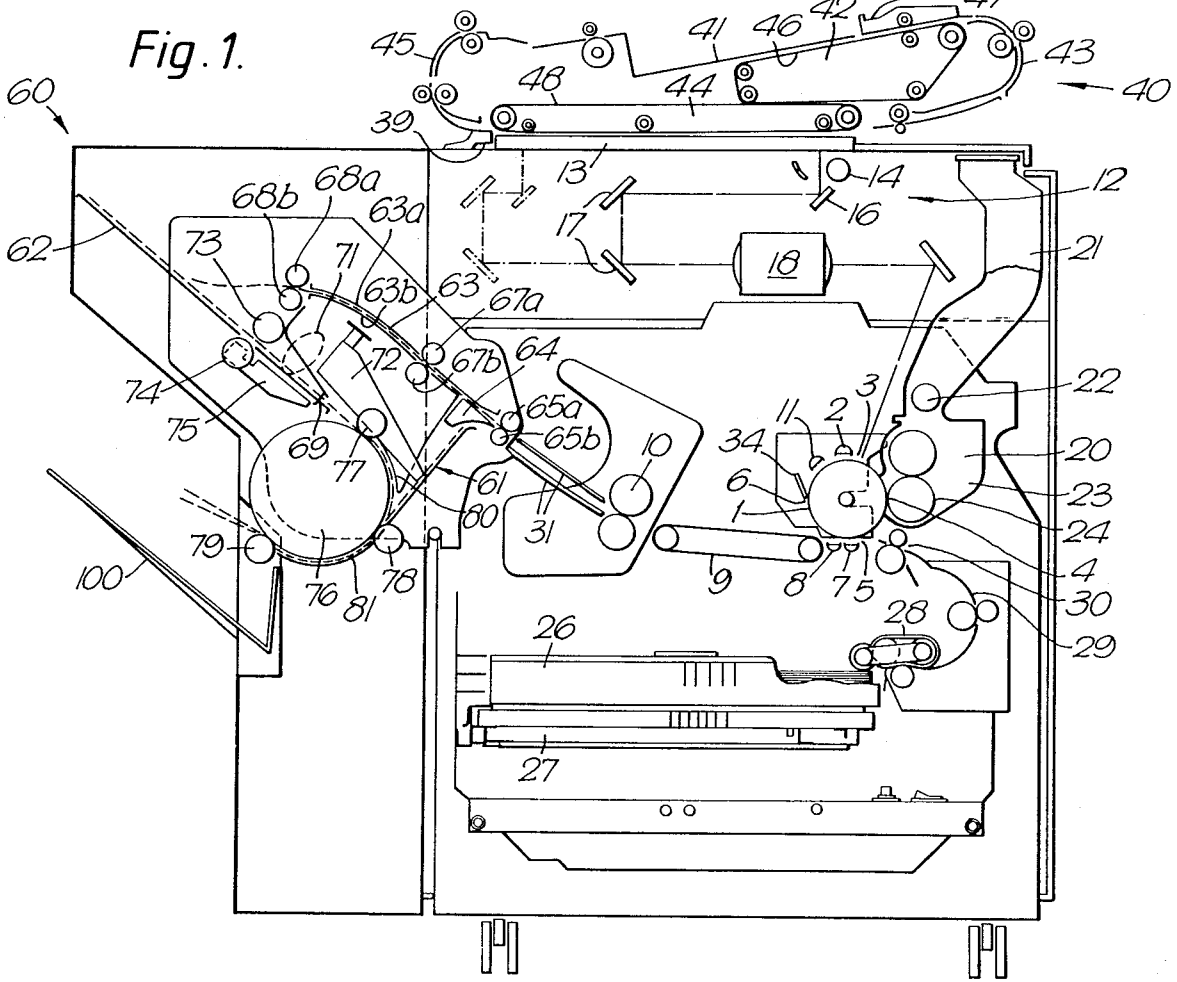
Figure 2:
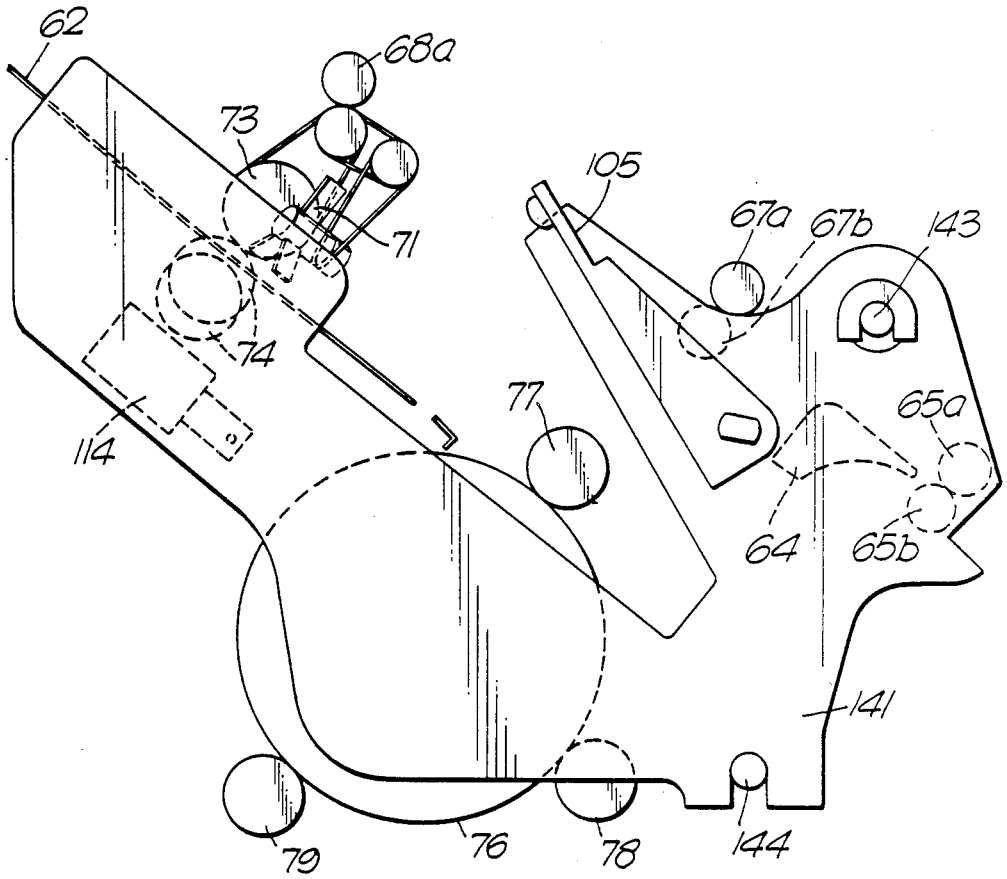
Figure 3:
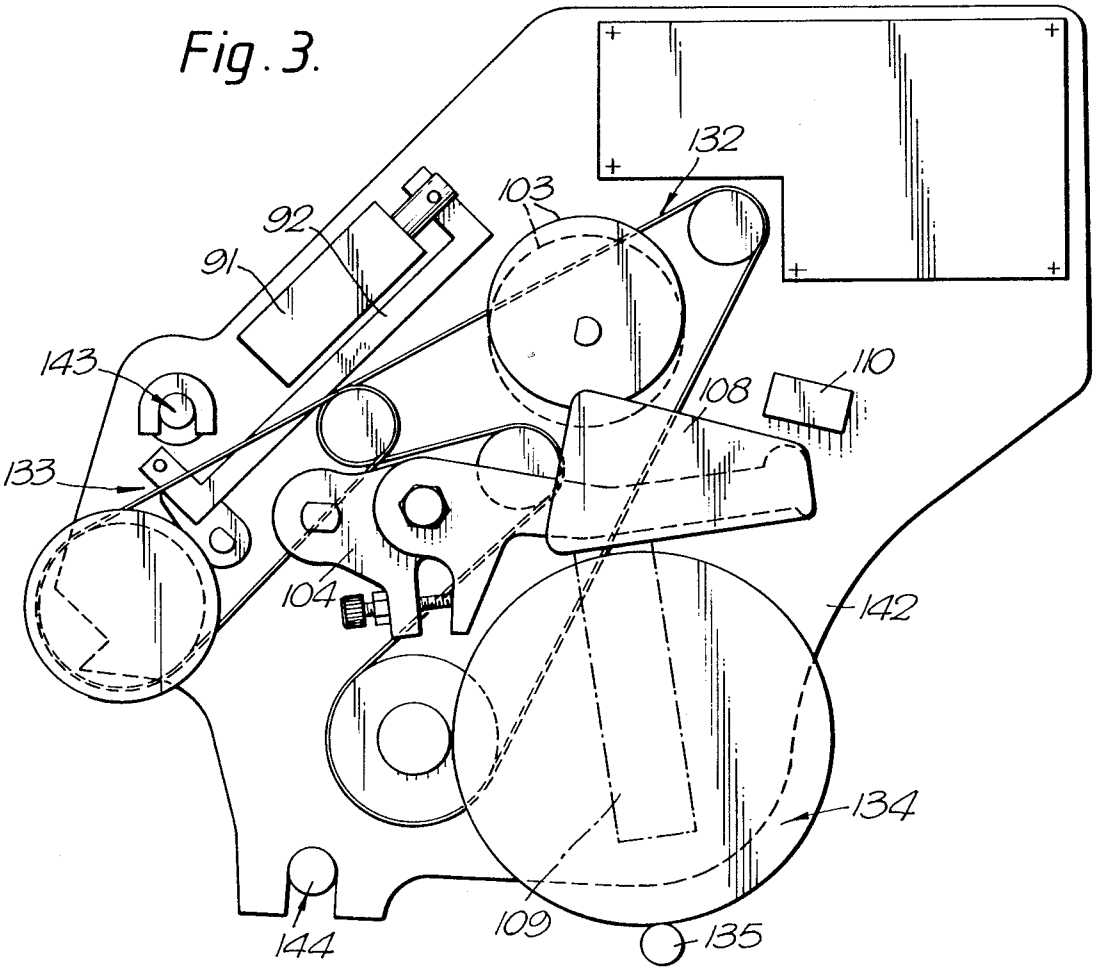
Figure 4:
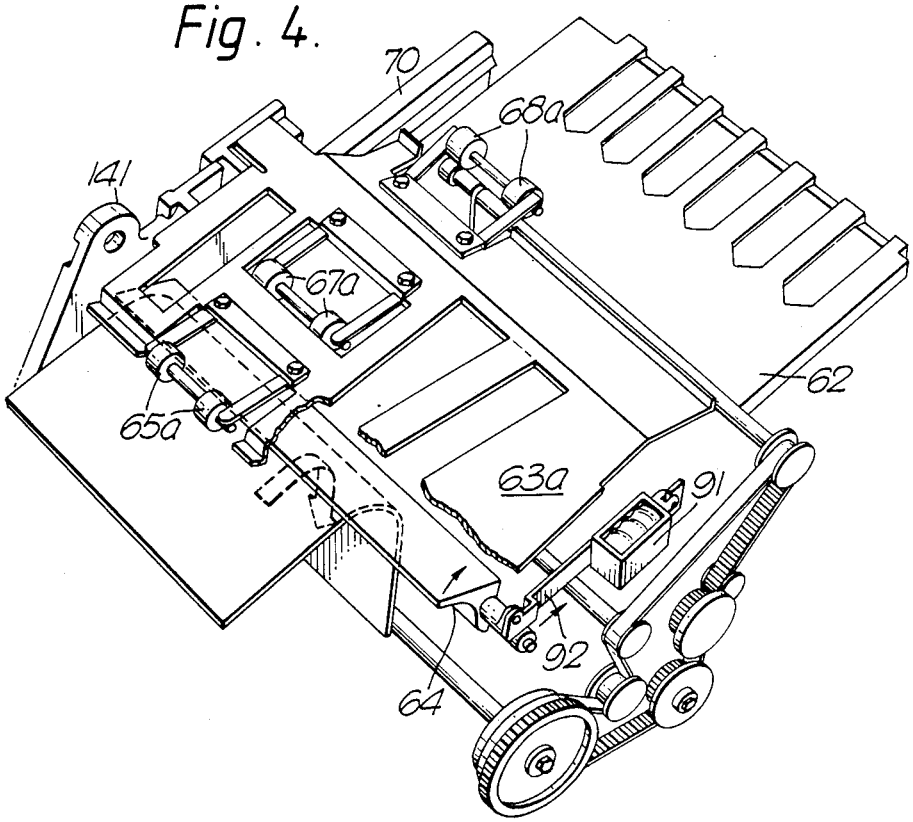
Figure 5:
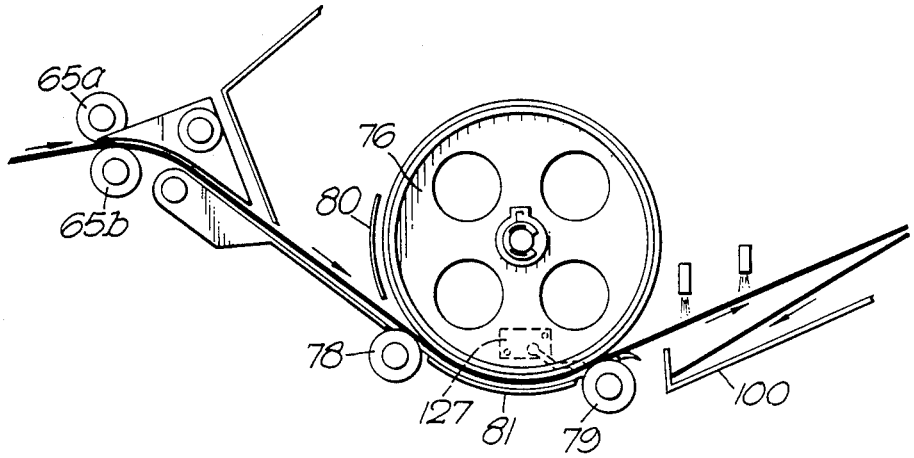
Figure 6:
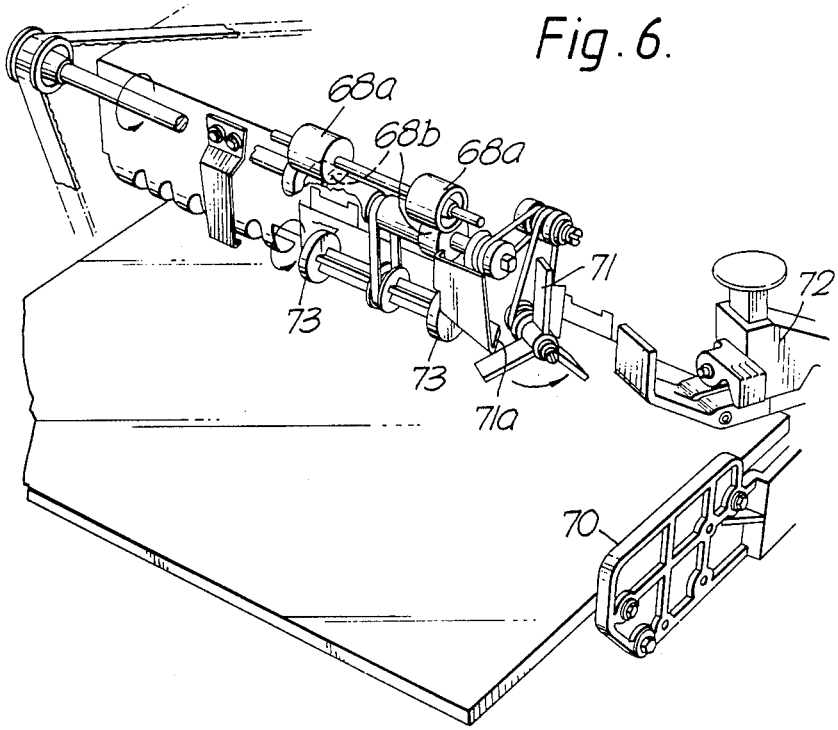
Figure 7:
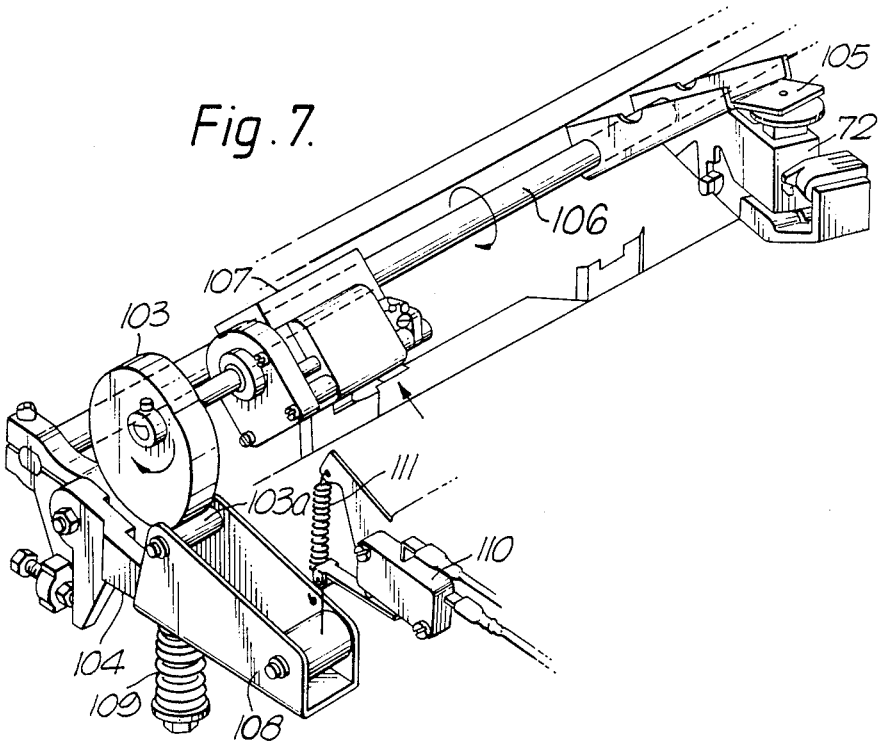
Figure 8:
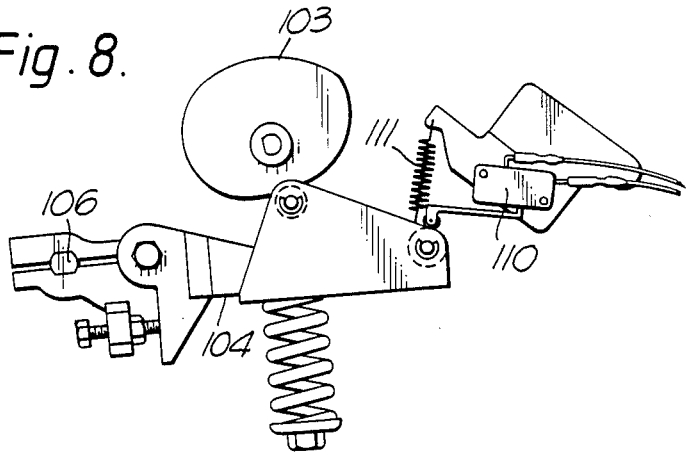
Figure 9:
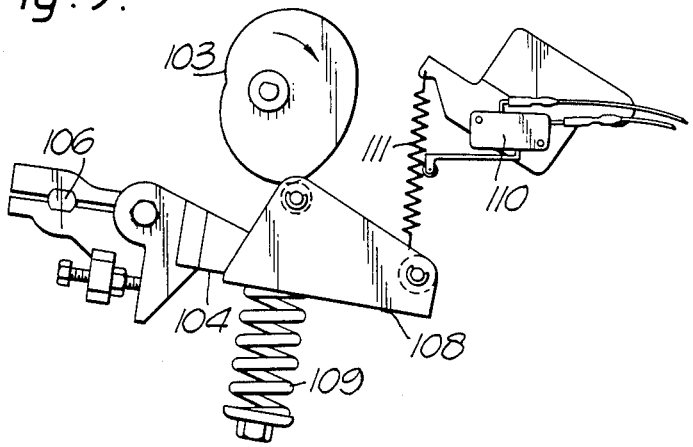
Figure 10:
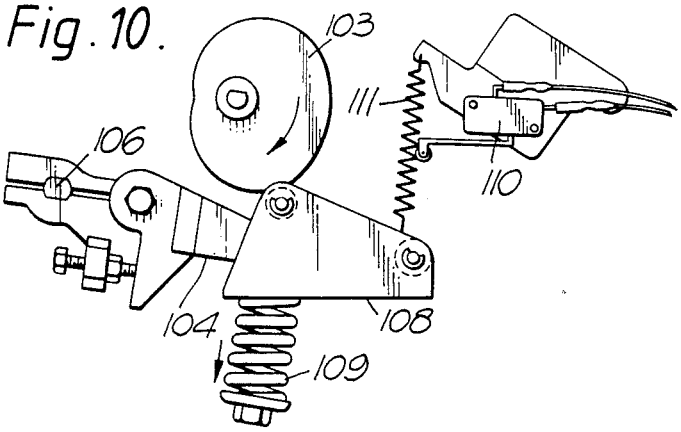
Figure 11:
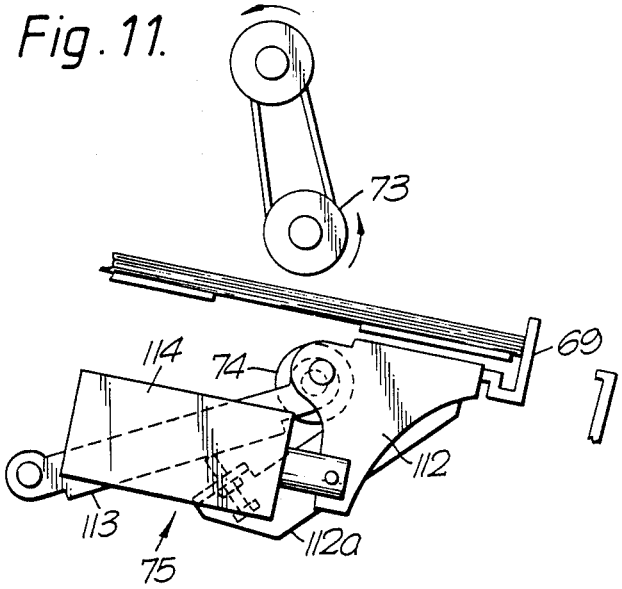
Figure 12:
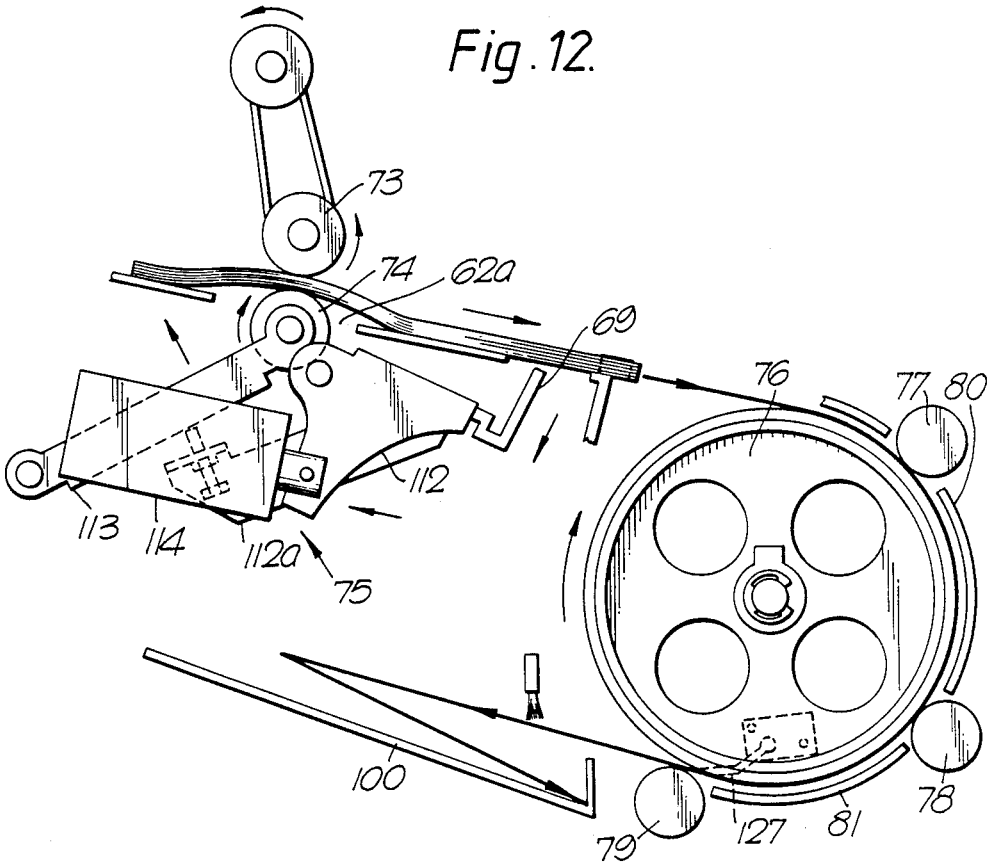
Figure 13:
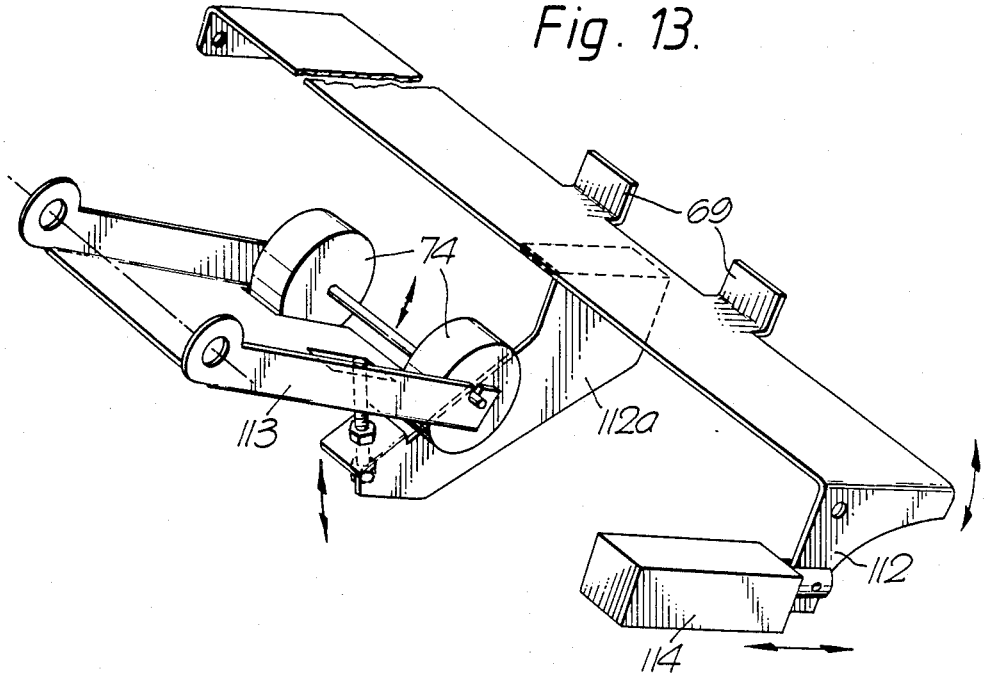
Figure 14:
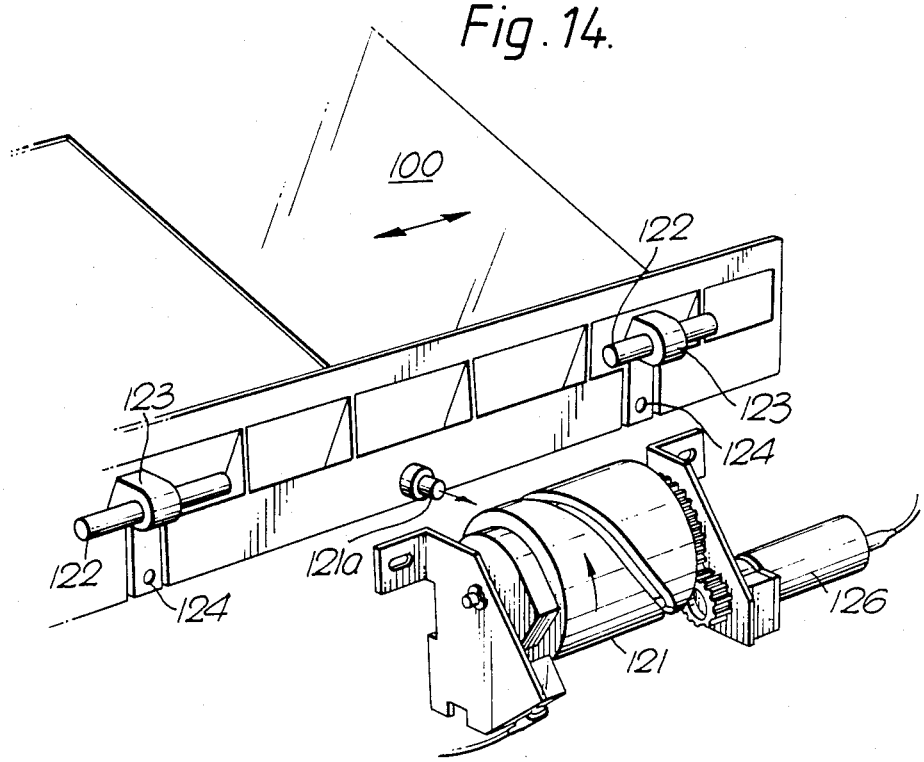
Figure 15:
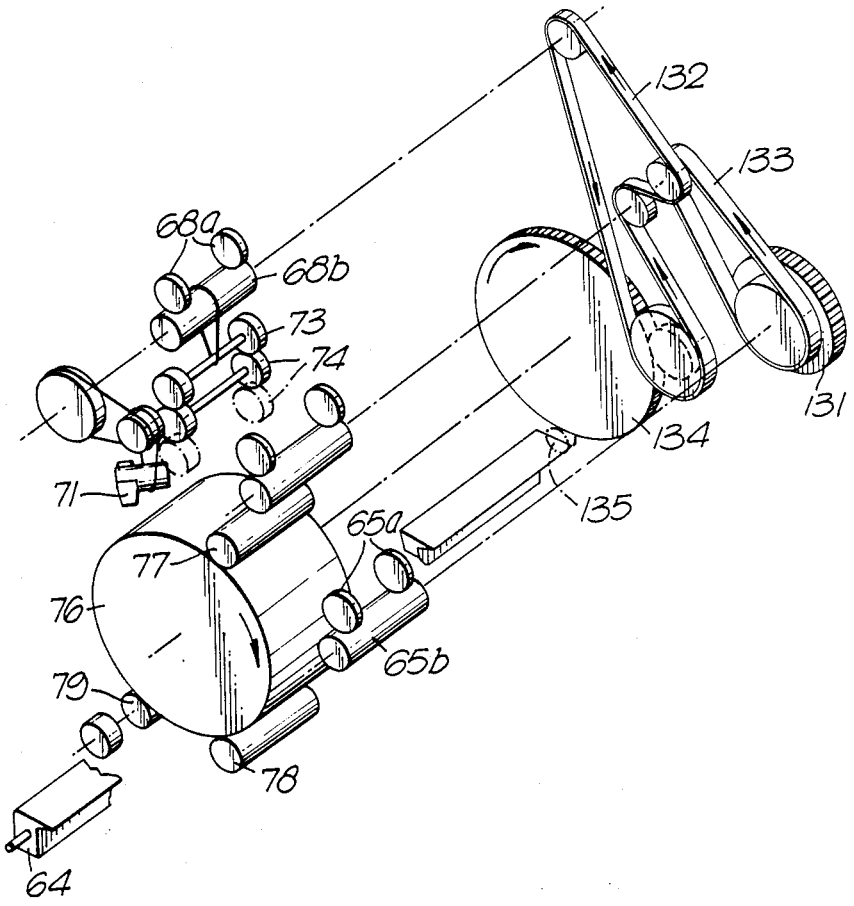

In order that the invention may be more readily understood, reference will now be made to the accompanying drawings, in which:

FIG. 1 is a schematic front view of a photocopier incorporating a recirculating document handler and finisher according to the invention, FIG. 2 is a front view of the finisher shown in FIG. 1, FIG. 3 is a rear view of the finisher, FIG. 4 is a perspective view from above of the finisher, FIG. 5 is a schematic rear view showing a by-pass path for sheets, FIG. 6 is a perspective view from above of the compiler tray of the finisher, FIG. 7 is a perspective view of the stapler mechanism of the finisher, FIGS. 8 to 10 show the operation of the stapler drive mechanism under varying conditions, FIG. 11 is a front view of the eject mechanism showing the positions of the elements during sheet compiling, FIG. 12 is a view like that of FIG. 11 showing the positions of the elements during set ejection and also illustrating the eject path for the sets, FIG. 13 is a schematic perspective view of the mechanism as shown in FIG. 11, FIG. 14 is a partly exploded view of the set offsetting stacking tray, and FIG. 15 shows schematically the drives for the finisher.

Referring first to FIG. 1 there is shown a xerographic copying machine incorporating a recirculating document handler 40 and a finisher 60 according to the present invention. The machine includes a photoreceptor drum 1 mounted for rotation (in the clockwise direction as seen in FIG. 1) to carry the photoconductive imaging surface of the drum sequentially through a series of xerographic processing stations: a charging station 2, an imaging station 3, a development station 4, a transfer station 5, and a cleaning station 6.

The charging station 2 comprises a corotron which deposits a uniform electrostatic charge on the photoreceptor. A document to be reproduced is positioned on a platen 13 and scanned by means of a moving optical scanning system to produce a flowing light image on the drum at 3. The optical image selectively discharges the photoconductor in image configuration, whereby an electrostatic latent image of the object is laid down on the drum surface. At the development station 4, the electrostatic latent image is developed into visible form by bringing into contact with it toner particles which deposit on the charged areas of the photoreceptor. Cut sheets of paper are moved into the transfer station 5 in synchronous relation with the image on the drum surface and the developed image is transferred to a copy sheet at the transfer station 5, where a transfer corotron 7 provides an electric field to assist in the transfer of the toner particles thereto. The copy sheet is then stripped from the drum 1, the detachment being assisted by the electric field provided by an a.c. de-tack corotron 8. The copy sheet carrying the developed image is then carried by a transport belt system 9 to a fusing station 10.

After transfer of the developed image from the drum, some toner particles usually remain on the drum, and these are removed at the cleaning station 6. After cleaning, any electrostatic charges remaining on the drum are removed by an a.c. erase corotron 11. The photoreceptor is then ready to be charged again by the charging corotron 2, as the first step in the next copy cycle.

The optical image at imaging station 3 is formed by optical system 12. A document (not shown) to be copied is placed on platen 13 by the document handler 40, and is illuminated by a lamp 14 that is mounted on a scanning carriage which also carries a mirror 16. Mirror 16 is the full-rate scanning mirror of a full and half-rate scanning system. The full-rate mirror 16 reflects an image of a strip of the document to be copied onto the half-rate scanning mirror 17. The image is focussed by a lens 18 onto the drum 1, being deflected by a fixed mirror 19. In operation, the full-rate mirror 16 and lamp 14 are moved across the machine at a constant speed, while at the same time the half-rate mirrors 17 are moved in the same direction at half that speed. At the end of a scan, the mirrors are in the position shown in a broken outline at the left hand side of FIG. 1. These movements of the mirrors maintain a constant optical path length, so as to maintain the image on the drum in sharp focus throughout the scan. Alternatively the optical system 12 may be fixed in position and the document scanned by being advanced across it by the document handler 40 as described below.

At the development station 4, a magnetic brush developer system 20 develops the electrostatic latent image. Toner is dispensed from a hopper 21 by means of a rotating foam roll dispenser 22, into developer housing 23. Housing 23 contains a two-component developer mixture comprising a magnetically attractable carrier and the toner, which is brought into developing engagement with drum 1 by a two-roller magnetic brush developing arrangement 24.

The developed image is transferred, at transfer station 5, from the drum to a sheet of copy paper (not shown) which is delivered into contact with the drum by means of a paper supply system 25. Paper copy sheets are stored in two paper trays, an upper, main tray 26 and a lower, auxiliary tray 27. The top sheet of paper in either one of the trays is brought, as required, into feeding engagement with a common, fixed position, sheet separator/feeder 28. Sheet feeder 28 feeds sheets around curved guide 29 for registration at a registration point 30. Once registered, the sheet is fed into contact with the drum in synchronous relation to the image so as to receive the image at transfer station 5.

The copy sheet carrying the transferred image is transported, by means of vacuum transport belt 9, to fuser 10, which is a heated roll fuser. The image is fixed to the copy sheet by the heat and pressure in the nip between the two rolls of the fuser. The final copy is fed by the fuser rolls along output guides 31 to the input nip 65 of the finisher 60.

After transfer of the developed image from the drum to the copy sheet, the drum surface is cleaned at cleaning station 6. At the cleaning station, a housing 33 forms with the drum 1 an enclosed cavity, within which is mounted a doctor blade 34. Doctor blade 34 scrapes residual toner particles off the drum, and the scraped-off particles then fall into the bottom of the housing, from where they are removed by an auger.

As mentioned above, sheets 5 may be fed from either the main tray 26 or the auxiliary tray 27. The auxiliary tray is of larger size than the main tray, enabling a wide choice of paper sizes and types to be fed from it. The trays are physically located in the lower part of the machine below the photoreceptor drum 1.

As shown in FIG. 1 a recirculation document handler 40 is provided for feeding documents to be copied to the platen 13 of the photocopier. The document handler includes a storage tray 41 for the documents to be copied and document circulating means for delivering the documents in turn to the platen from the storage tray and for returning the documents to the tray, whereby the documents may be circulated and recirculated in sequence past the platen for repeated copying (precollation mode). The documents may either be transported across the platen at a constant velocity past the optical system 12 of the photocopier which is held stationary in the solid line position shown, or instead they may be registered on the platen prior to copying and the stationary document exposed by scanning the optical system 12 across the document as described above. For this prupose a registration member or gate 39, which can be moved in and out of sheet blocking position at the registration edge of the platen by means of a conventional solenoid type actuator, is provided for registering the document in stationary position on the platen 13 while the optical system 12 is scanned across the document. When the document is registered on the platen, the document handler can be operated in so-called stacks mode wherein each document is copied a plural number of times during a single delivery to the platen.

The document handler comprises, in addition to the storage tray 41, a document separator/feeder 42, a pre-platen transport 43 for conveying documents to the platen, a platen transport 44 and a post-platen transport 45 by which documents are returned to the storage tray.

The document storage tray 41 is mounted over the platen 13 and slopes upwardly towards the separator/-feeder 42; it is adjustable to accommodate different document sizes.

Sheet separation and acquisition is accomplished by a vacuum belt corrugation feeder (VCF) 42 using flotation pressure differences between the bottom sheet and the sheets above, sheet corrugation and vacuum, a parabolic contour pocket being cut out at the lead edge of the tray 41 and dished down in the manner shown and described in U.S. Pat. No. 4,275,877. Documents placed in the tray, bridge this gap and form a flotation pocket. Transport belts 46 surface through the document tray within the contour pocket. Document stack flotation is accomplished by a frontal assault of air from an air knife 47. The air jet impinges on the tray just in front of the lead edge of the document stack; this permits volumetric flow expansion of air within the pocket contour of the tray and also riffles the front edge of the documents to allow a differential pocket of air between the bottom sheet and sheet 2. This assists in the acquisition, separation and feeding of the bottom document.

The pre-platen and post-platen transports 43, 44 consist of pairs of nip rolls and inner and outer inversion guides as shown and the platen transport 45 comprises a single white, wide friction drive belt 48 entrained over input and output transport rollers 49. The document is transported across the platen 3 by the belt 48. Three gravity rolls apply a nip between the belt 48 and platen 13 and maintain drive across the platen.

The document handler may be operated as described above either in pre-collation (or sets) mode in which the pages of a document are copied one at a time in serial number order or in post-collation (or stacks) mode in which multiple copies of each document sheet are made before the next document sheet is copied. In accordance with the invention a copy sheet finishing apparatus 60 capable of handling output for the document handler in both these modes is shown in FIG. 1.

The finisher 60 includes an offsetting catch tray or output tray 100 and may be operated to perform the following functions:

(a) to compile, register and corner staple sets of copies as they are produced and transport the stapled sets into the offsetting catch tray 100, and (b) to deliver copies direct to the offsetting catch tray 100 where the sheets may be compiled in offset sets.

In a variation of (a) the stapling step may be omitted.

The finisher receives copy sheets from the processor at input nip 65 and conveys them to the offsetting catch tray 100 either directly along a path 61 or, via a compiler tray 62 in which they are registered and stapled, along a path 63. The direction of the sheets is determined by a diverter 64 located directly following the finisher input nip rolls **65*a*, 65*b*** and which is operated in response to a signal from the processor initiated by the operator.

The path 63 comprises upper and lower guides **63*a*, 63*b* and includes two further sets of nip rolls 67, 68 which accelerate the sheets into the compiler tray 62. The sheets are corner registered against a retractable end registration gate 69 and a side registration gate 70 at the front of the machine by gravity and a paddle wheel 71, represented in FIG. 1 by a broken ellipse. Sets compiled in the tray 62 are corner stapled by a stapler 72. Stapled sets are driven from the tray 62 by retracting the gate 69 and lifting the set against a pair of driven eject rolls 73 by means of a pair of idler rolls 74 mounted on one end of pivoted arm 75 which carries the gate 69** at its other end.

Thus the sheets are conveyed into the compiler tray in a first direction (from right to left in FIG. 1) and their trail edges registered by being conveyed against the end registration gate 69 in the opposite direction (from left to right in FIG. 1). The path 63 extends over the paddle wheel 71 and the eject rolls 73 and the sheets drop by gravity towards the end registration gate 70 since the tray 62 slopes downwardly in that direction at an angle of between 35 and 45 degrees. In the embodiment of FIG. 1 the angle is 38 to 42 degrees, preferably 40 degrees. Essentially the tray angle must be sufficient for the sheets to drop by gravity into the influence of the paddle wheel 71.

The sets are carried into the offsetting catch tray 100, which is arranged beneath the compiler tray 62, around a large driven, rigid sun roll 76 with the aid of three driven, compliant planet rolls 77, 78, 79 and outer guides 80, 81. Thus as the sets are conveyed to the offsetting catch tray 100 they are inverted and their direction reversed. The catch tray 100 itself slopes downwardly in the same direction as the compiler tray 62 suitably at an angle of 35 to 40 degrees, preferably 40 degrees.

In sets copying mode, a document set to be copied is placed face up in the document handler tray 41 so that the pages of the document are copied in reverse order. Thus, copy sheets are delivered to the compiler tray of the finisher in the order n−1. The copy sheets are received face-up so that the assembled set is in page number order and are fed through the copier long edge first so that the top of the page is at the front side of the machine. Accordingly the top left-hand corner of the set is arranged in the registration corner and is stapled. Thus sets stapled in the compiler tray 62 are received face-down in the catch tray 100 with the stapled corner at the upper front of the tray.

The above-described configuration provides a compact finisher in which the extent to which the finisher projects beyond the processor is kept to a minimum. At the same time it permits sheets which do not need to be stapled to be fed directly to the catch tray 100.

Thus, where stapling is not required sheets are directed along path 62 into engagement with the roller 76 and driven into the tray 100 with the aid of driven foam rolls 78, 79. The tray 100 may be offset sideways between sets to provide visual and physical separation between the sets.

The finisher 60 will now be described in greater detail.

Sheets from the fuser 10 of the processor enter the finisher through the input nip rolls 65 which comprise a lower steel roll **65*b* incorporating a one-way or overrun clutch with a pair of rubber bands thereon and a pair of upper idler acetal rolls 65*a*. Drive to the lower rolls 65*b* (and to all driven rolls of the finisher) is from the processor output spur gear (not shown). The rolls 65 assist in driving the copies to the diverter 64, and beyond. The diverter 64 extends across the paper path and has the cross-section shown in FIG. 1. It is operated by a solenoid 91 (FIG. 4) through a linkage 92. The solenoid is energised to direct sheets along path 63 into the compiler 62**.

The upper transport path 63 comprises upper and lower sheet metal guides **63*a*, 63*b* and the two further sets of nip rolls 67, 68. These comprise upper idler acetal rolls 67*a*, 68*a* and lower driven polyurethane rolls 67*b*, 68*b*. In order to project the sheets positively onto the compiler tray 62, over the paddle wheel 71 and eject roll 73, the nip rolls 67, 68 are driven at a faster rate than the rolls 65. The one-way clutch in the lower roll 65*b* prevents the copies from being torn or scrubbed. The idler rolls 67*a*, 68*a* as well as the input idler rolls 65*a* are mounted on the upper guide plate 63*a* which is hinged from the back of the finisher for jam access. The nip roll sets 65, 67, 68 serve to corrugate the copy sheets and the idlers are fixed to the plate 63*a*** by snap-on flexures.

On reaching the compiler tray 62 the copy sheets are reverse corner registered against end registration stops 69 and side registration plate 70 at the front of the machine by a driven 3-bladed paddle wheel 71 (FIGS. 2 and 6). The paddle wheel is straight-bladed and is made of polyurethane. For improved registration the blades flip down on to the sheets from a restraining plate **71*a***.

The stapler 72 is arranged over the registration corner as shown in FIG. 6 to insert a staple through that corner of the set. The stapler is actuated when the processor logic detects that a complete set has been delivered to the compiler tray 62. The stapler inserts staples at an angle of 20° to the long edge of the set.

Referring to FIGS. 7 to 10, the stapler 72 is a standard desk top stapler with a conventional head 101 and passive clincher (not shown). It has a capacity of 160 staples and can staple up to 25×80 gm. sheets. Drive to the stapler is by a motorised cam 103, a cam lever 104, a staple head lever 105 and a connecting shaft 106. This arrangement allows the cam drive to be positioned at the rear of the machine although the stapler is at the front. Adjustment for the staple head lever position is provided by a knuckle joint in the cam lever 104. The stapler is driven by a separate AC motor/gearbox 107 (FIG. 7).

A load limiting device is incorporated into the cam lever 104 to (a) accommodate varying set thicknesses presented to the stapler and (b) enable the cam 103 to rotate in the event of seizure or staple jam. This device comprises a bracket 108 pivoted to the cam lever 104 and connected to it through a compression spring 109. The cam follower **103*a* is mounted on the bracket 108 and relative movement of the bracket 108 and lever 104 limits the force applied by the staple head lever. Thus, if the staple head is closed before the cam 103 has completed its cycle, excess movement is absorbed by the cam lever bracket 108 as shown in FIG. 10. The load limiting spring 109 prevents the bracket 108** from pivoting prematurely.

Located just above the back edge of the cam lever bracket 108 is a micro-switch 110. As the lever/bracket assembly moves up and down electrical continuity through the microswitch is interrupted. This signal is used to monitor cam rotation and may assist in staple jam detection.

Return of the stapler head to an open position after each stapling operation is assisted by a spring 111 attached between the bracket 108 and the finisher frame and a spring integral with the stapler head.

Staple levels in the magazine are monitored by a low staple sensor (not shown) activated when only twenty four staples remain. This sensor is an optical sensor consisting of an infra-red source and a detector aligned with holes through the staple rail. A signal from the sensor allows the processor logic to assess how many sets are outstanding against the ongoing job and act accordingly.

A solenoid 114 (FIG. 3) mounted under the compiler tray 62 acts on pivoted arm 75 which as shown in FIGS. 11 to 13 comprises levers 112 and 113. Lever 112 is attached to gate 69 and through an intermediate lever **112*a* operates a lever 113 carrying the eject (kick-out) idler rolls 74. During compiling and stapling the rolls 74 and gate 69 are as shown in FIG. 11. Once the stapling operation has been completed, the solenoid 114 is energised to pivot the levers 112. 113 as shown in FIG. 12, retracting the gate 69 and lifting rolls 74 through a cut-out 62***a* in the compiler tray to nip the set against continuously driven rolls 73 and drive the set out of the compiler tray.

The rolls 73 and 74 each comprise a spaced pair of grooved rolls with O-ring inserts. The idlers 74 are spaced slightly further apart than the driven rolls 73.

Stapled sets are transported to the catch tray 100 around transport roll 76 which is 70 mm wide and 135 mm in diameter. It has a rigid hub of a thermoplastic resin material, suitably a modified polyphenylene oxide such as Noryl, with a high friction polyurethane coating. Suitably the surface of roll 76 has a hardness of 60±5 IRHD. Transport of the sets around sun roll 76 is aided by the compliant rolls 77, 78, 79 and the guides 80, 81. The planet rolls 77, 78, 79 are foam rolls 30 mm in diameter and having a 10 mm thick layer of foam over a rigid hub. The foam material is a polyurethane ester suitably having a cell size of 18 cells per linear centimeter. The planet rolls 77, 78, 79 are driven at a slightly greater speed (about 10% or more faster) than the sun roll 76 to compensate for the difference in speed between the inner and outer surfaces of a set being transported. In one embodiment in which the rolls have the dimensions above the sun roll 76 is driven at a surface speed of 307 mm/sec and the planet rolls 77, 78, 79 are respectively driven at surface speeds of 353 mm/sec (15%), 402 mm/sec (31%) and 335 mm/sec (9%), the percentages in parenthesis indicating the amount by which the speed of the sun roll is exceeded. The guide 81 can be hinged down for jam access.

With the diverter solenoid 91 not energised, the diverter 64 is kept raised by a compression spring around the solenoid plunger and sheets are directed along the path 61 directly to the eject roll 76 and the catch tray 100.

The transport roll 76, like the nip rolls 67, 68, accelerates copies from the input rolls 65 to minimise set delivery time.

The offsetting catch tray 100 (FIG. 14) provides physical and visual distinction between consecutive sets and this is achieved by reciprocating the tray through 35 mm. The tray is driven by a separate DC motor/-gearbox through a cylindrical cam 121 and follower 121*a*. The tray slopes upwardly at a relatively steep angle and has an upstanding rear registration edge 126. The tray is slideably mounted on stub shafts 122 carried on the finisher cover by means of brackets 123. Reaction studs 124 on the tray edge 126 ride on PTFE strips fixed to the outside of the cover. The catch tray is activated by a sensor switch 127 (FIG. 12) in the lower part of the set transport.

A spring loaded rib 1½-2" wide extends downwardly along the tray to maintain uniform drop height into the tray as the sheets build up. Mylar control strips (not shown) hang from the cover above the tray to help guide paper onto the tray.

The finisher drives are shown in FIGS. 3 and 15. A spur gear 131 takes the drive from the processor and apart from the roll 65*b* which is driven directly from the spur gear 131 all driven rollers and the paddle wheel are driven via toothed belts 132, 133 and spur gears 134, 135. The latter are all arranged at the back of the finisher behind the rear frame 142 as shown in FIG. 3. Front and rear frames 141, 142 moulded in plastic support all finisher components. The two frames are separated structurally by two steel tie bars, the lower plate 63*b* of upper transport guide 63 and the compiler tray (sheet steel).

The finisher and its covers are mounted separately. As shown in FIGS. 2 and 3, downwardly facing U-mountings of the frames 141, 142 sit on docking studs 143, 144 projecting from the processor frame and the assembly is held in position by gravity. The cover is held in place by four latch mechanisms, two front and two rear, which locate on docking studs fixed to the processor frames. The rear latches are secured by locking screws.

In operations sheets are either delivered to the compiler tray 62 along the upper path 63 or fed directy to the offsetting catch tray 100 along the path 61. In the latter case the sheets may be stacked in offset sets by intermittently side-shifting the tray 100 under the control of the machine logic. Sheets delivered to the compiler tray 62 are reverse registered by gravity and the paddle wheel 71 against registration stops 69, 70. When all the sheets in a set have been received in the tray 62, the machine logic activates the motor 107 to cause the stapler 72 to insert a staple in the set and then activates the solenoid 114 to cause the gate 69 to retract and the eject rolls 73, 74 to engage the set to drive the set out of the tray to the direction reversing transport formed by the transport roll 76 and its associated planet rolls and guides. The transport conveys the set into the offsetting catch tray 100 where successive sets are stacked for collection by an operator. The catch tray may be offset between sets.

The compiler tray will not accept more than 25 sheets. If the finisher is in binding mode and a sensor (not shown) in the path 63 has counted 25 sheets, it will direct the twenty-sixth and subsequent sheets directly to the catch tray 100 and also eject the stack of sheets in the tray 62 into the tray 100 without binding them.

Although specific embodiments have been described, it will be understood that various modifications may be made without departing from the scope of the invention as defined in the appended claims. For example, while a paddle wheel registration device is described and illustrated any suitable form of sheet registration device may be employed.

I claim:

1. Copy finishing apparatus for collecting sheets into sets, comprising a compiling surface for compiling sheets fed serially thereto into sets, end and side registration stops, means arranged over said compiling surface for corner registering the sheets against the end and side registration stops, means for conveying sheets onto the compiling surface in a first direction over the registration stops, said compiling surface sloping downwardly in the opposite direction toward said end registration stop whereby sheets delivered onto said surface beyond said end registration stop in said one direction will move under gravity toward said end registration stop.

2. Copy finishing apparatus according to claim 1 further including binding means arranged over said surface, the means for conveying sheets to the surface extending thereover.

3. Copying finishing apparatus according to claim 1 in which the end registration stop is retractable for ejecting compiled sets from said surface.

4. Copying finishing apparatus according to claim 1 further including a support surface arranged for receiving and stacking sets from the compiling surface.

5. Copy finishing apparatus according to claim 4 in which said support surface is arranged underneath said compiling surface, a direction reversing path arranged between said compiling surface and said support surface, and transport means is provided for conveying sets around said direction reversing path.

6. Copying finishing apparatus according to claim 4 further including means for directing single sheets directly to said support surface.

* * * * *